US005662296A

United States Patent [19]

Wu

[11] Patent Number: 5,662,296

[45] Date of Patent: Sep. 2, 1997

[54] CONTROLLING MEANS OF A GOLF BAG STAND

[75] Inventor: Fang-Li Wu, Tainan Hsien, Taiwan

[73] Assignee: Sports World Enterprise Co., Ltd., Tainan Hsien, Taiwan

[21] Appl. No.: 596,610

[22] Filed: Feb. 5, 1996

[51] Int. Cl.[6] ..... A63B 55/00

[52] U.S. Cl. ..... 248/96; 206/315.7; 248/169; 248/221.11; 248/223.41

[58] Field of Search ..... 248/96, 166, 169, 248/688, 221.11, 222.11, 223.41, 225.11, 297.21, 297.31; 206/315.3, 315.7

[56] References Cited

U.S. PATENT DOCUMENTS

| | | | |
|---|---|---|---|
| 1,924,182 | 8/1933 | Fritz | 206/315.7 X |
| 4,973,084 | 11/1990 | Biller | 248/297.31 X |
| 5,036,974 | 8/1991 | Ross, Jr. | 248/96 X |
| 5,154,377 | 10/1992 | Suk | 248/96 |
| 5,156,366 | 10/1992 | Anderson | 248/96 |
| 5,332,183 | 7/1994 | Kagayama | 248/223.41 X |
| 5,356,105 | 10/1994 | Andrews | 248/221.11 |

FOREIGN PATENT DOCUMENTS

| | | | |
|---|---|---|---|
| 2112650 | 7/1983 | United Kingdom | 248/96 |

*Primary Examiner*—Leslie A. Braun
*Assistant Examiner*—Derek J. Berger
*Attorney, Agent, or Firm*—Morton J. Rosenberg; David I. Klein

[57] ABSTRACT

A controlling device of a golf bag stand is coupled to a golf bag and operationally associated with a blocking plate, curved bars, a U-shaped bar, a pair of propping bars and a fixed plate, provided as a golf bag stand. The fixed plate is coupled on an upper portion of the golf bag. The controlling device includes a fixed plate and a movable block having a cavity, a retained element disposed within the cavity, and a pushing block operationally associated with, and able to displace the retained element. A finger element is coupled to the pushing block, which is pushed downward to displace the retained end of the retained element from an upper recess or a lower recess of the fixed plate, allowing the movable block to be displaced. The propping bars are stretched outward to support the golf bag when the retained end is moved to the lower recess and withdrawn when the retained end is moved to the upper recess.

4 Claims, 10 Drawing Sheets

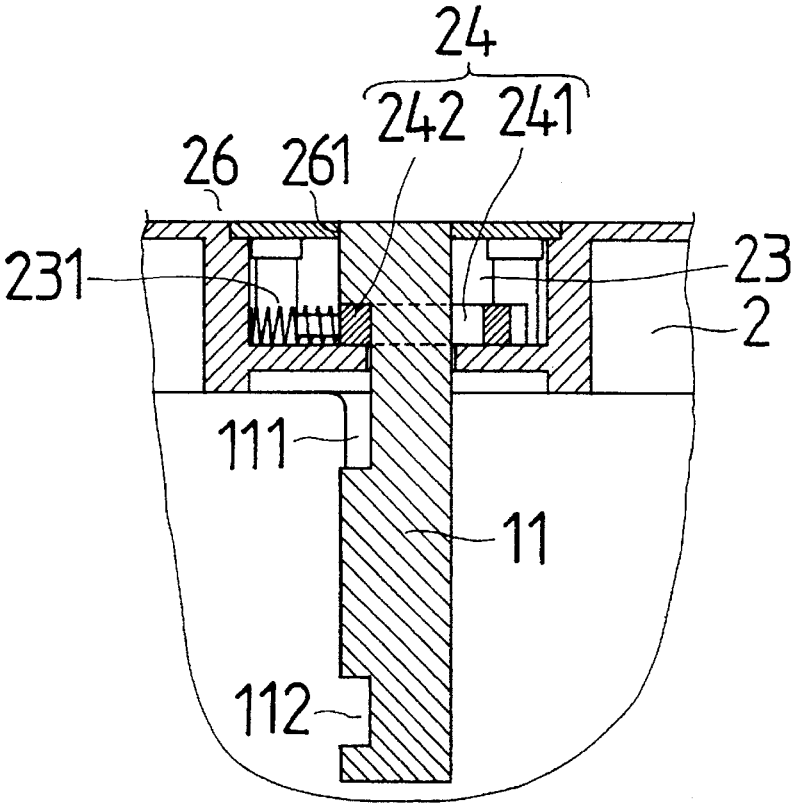
FIG.5
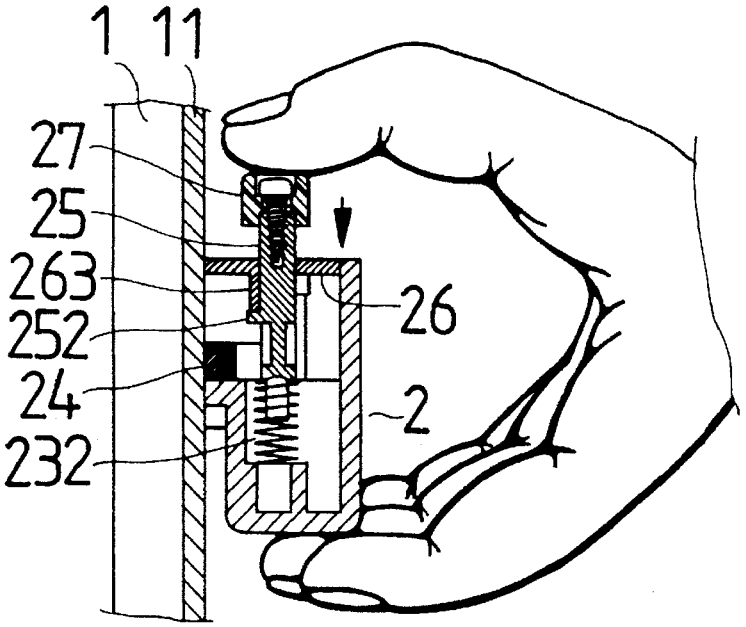
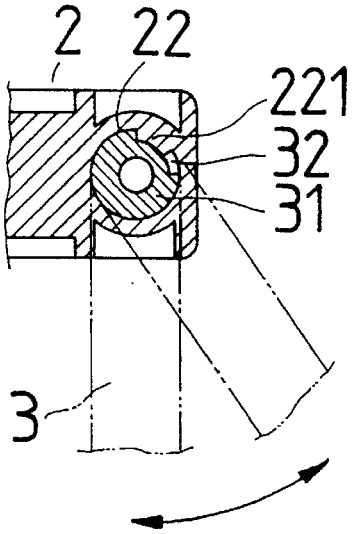
FIG.8
FIG.6

CONTROLLING MEANS OF A GOLF BAG STAND

BACKGROUND OF THE INVENTION

A heretofore known controlling means of a golf bag stand, as shown in FIGS. 11–15, is commonly provided with a fixed plate 10, a movable block 20, a U-shaped bar 60, a pair of propping bars 30, a blocking plate 50, curved bars 501 and a bottom part 40. The fixed plate 10 is fitted to an upper portion of a golf bag. The movable block 20 is operatively associated with and movable along the fixed plate 10, and the pair of propping bars 30 are adapted to support the golf bag. The bottom part 40 is fitted to a bottom portion of the golf bag. The blocking plate 50 is connected to the bottom part 40, and the curved bars 501 are connected to the blocking plate 50. The U-shaped bar 60 being shaped as a "U" with its bottom end 601 bent at an angle and being movably associated with the propping bars 30 by means of two open ends thereof.

Furthermore, the upper ends of the propping bars 30 are bent at an angle, and the movable block 20 has two holes on two sides thereof to hold the bent portions of the propping bars 30.

The fixed plate 10 has a slot 101 and a through hole 102 formed therein. A spring 202 and a T-shaped control 203 are included, the T-shaped control having a rod 204 extending between the fixed plate 10 and the movable block 20 to enable the movable block 20 to be moved up and down together with T-shaped control 203 along the fixed plate 10. The rod 204 of the T-shaped control 203 is moved between a first position and a second position by first pulling the T-shaped control 203 outward. The first position is the slot 101 and the second position is a through hole 102 of the fixed plate 10. The spring 202 is able to make the rod 204 of the T-shaped control 203 snap back into either of the first or second positions by means of its bias force.

The propping bars 30 are able to be moved between an in-use position and a not-in-use position by shifting the rod 204 of the T-shaped control 203 to the second position and the first position. When the rod 204 is retained in the first position, the propping bars 30 are positioned relatively close to the golf bag, i.e., in the not-in-use position. When the rod is shifted to be retained in the second position, the propping bars 30 will be stretched outward, i.e., positioned in the in-use position for the golf bag to be supported by the propping bars 30 to stand at an angle. The weight of the golf bag and golf clubs therein starts to effect the U-shaped bar 60 immediately after the rod 204 is shifted to the second position, the U-shaped bar 60 being effected by the weight to stretch outward and thereby make the propping bars 30 be further stretched outward. Stretching of the U-shaped bar 60 is stopped as soon as the bottom end 601 of the U-shaped bar 60 moves into contact with the blocking plate 50.

From the above described controlling means of golf bag stands and the use thereof, it can be understood that it has disadvantages as follows:

1. to move the rod 204 of the T-shaped control 203 between the first position and the second position, a user first has to pull the T-shaped control 203 outward, whereby the fingers and thumb of the user are subject to pain due to bias force of the spring 202; and, 2. movement thereof is ineffective and inconvenient in terms of the required biomechanics of the user.

SUMMARY OF THE INVENTION

The present invention relates to a controlling means of a golf bag stand comprising a movable block to be operationally associated with a fixed plate. A U-shaped bar, a pair of propping bars and two curved bars of a golf bag stand are also included. The fixed plate is coupled to an upper portion of a golf bag, and the movable block is operatively associated with an able to move up and down along the fixed plate. The pair of propping bars are provided to support the golf bag. The curved bars are connected to a bottom of the golf bag, for securing a lower portion of the U-shaped bar. The U-shaped bar is shaped as a "U", having a bottom end bent at an angle and able to move relative to the propping bars by means of two ends thereof movably associated with the propping bars.

The fixed plate includes a guide on the intermediate portion thereof. An upper recess and a lower recess are provided on an upper portion and a lower portion of the guide, respectively.

The movable block further includes a cavity formed in an intermediate portion thereof, a guide holder, a retained element, a pushing block and a finger element. The retained element includes an inclined surface, a retained end and a recessed portion. The pushing block has an inclined surface and a protrusion. The upper plate has a guide holder and a through hole. The finger element and the pushing block are combined together with the upper plate positioned in between. The retained element is housed inside the cavity, the recessed portion thereof and the guide holder being operationally associated with and able to move relative to the guide of the fixed plate. The upper plate is connected over the cavity by screws. The pushing block is positioned above the retained element, with the inclined surface thereof positioned above the inclined surface of the retained element.

When the finger element is pushed downwardly, the movable block is displaced so that the golf bag stand is shifted to either an in-use position or a not-in-use position. The pushing block is simultaneously moved downwardly together with the finger element. The inclined surface of the pushing block pushes the inclined surface of the retained element operationally associated therewith, to separate the retained end from either the upper recess or the lower recess.

BRIEF DESCRIPTION OF THE DRAWINGS

The present invention will be better understood by reference to the accompanying drawings, wherein:

FIG. 5 is a cross-sectional view of a rear portion of a fixed plate combined with a movable block of a controlling means of a golf bag stand of the present invention;

FIG. 6 is a side-sectional view of a fixed plate combined with a movable block of a controlling means of a golf bag stand of the present invention;

FIG. 8 is a side-sectional view of a movable block combined with propping bars of a controlling means of a golf bag stand of the present invention;

DESCRIPTION OF THE PREFERRED EMBODIMENTS

Figure 1:
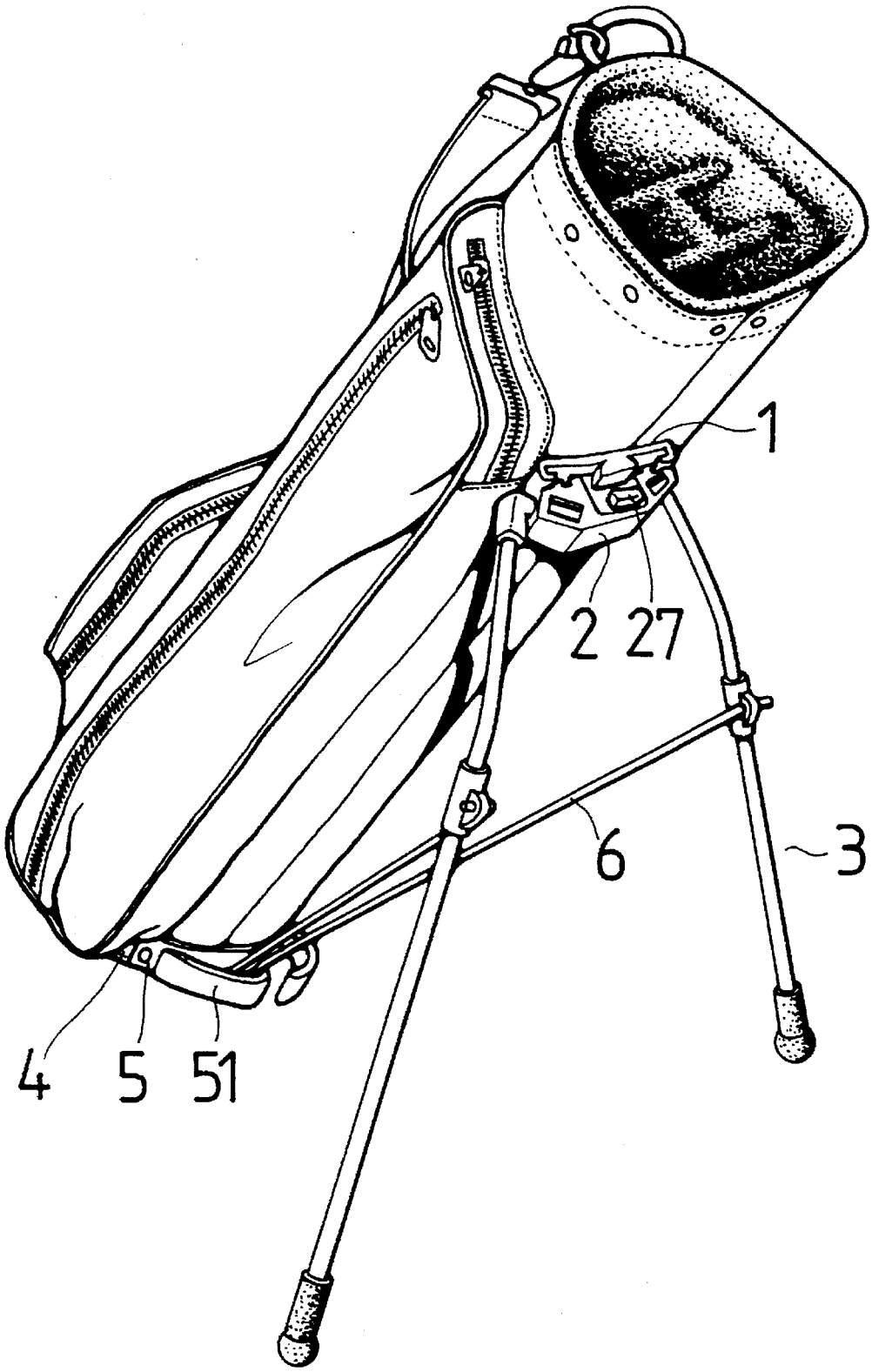
FIG. 1 is a perspective view showing a golf bag supported by a golf bag stand provided with a controlling means of the present invention.
Figure 2:
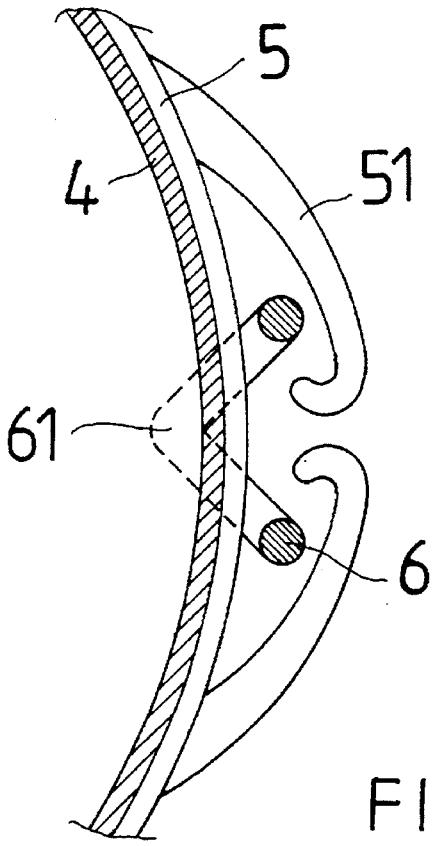
FIG. 2 is a cross-sectional view of a bottom part, a blocking plate and a U-shaped bar of a controlling means of a golf bag stand of the present invention.
Figure 3:
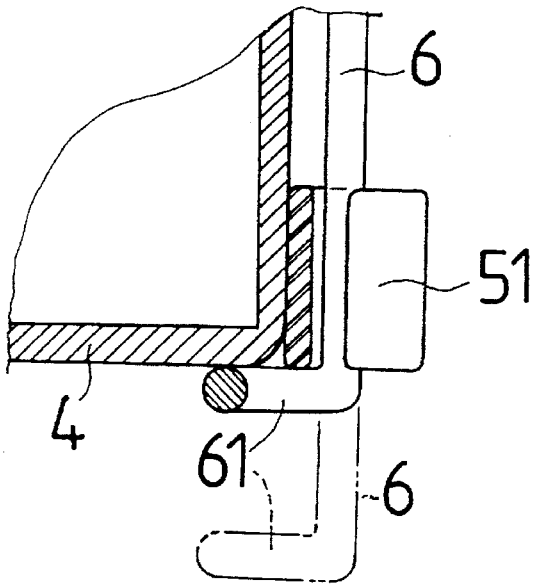
FIG. 3 is vertical-sectional view of a bottom part, a blocking plate and a U-shaped bar of a controlling means of a golf bag stand of the present invention.
Figure 4:
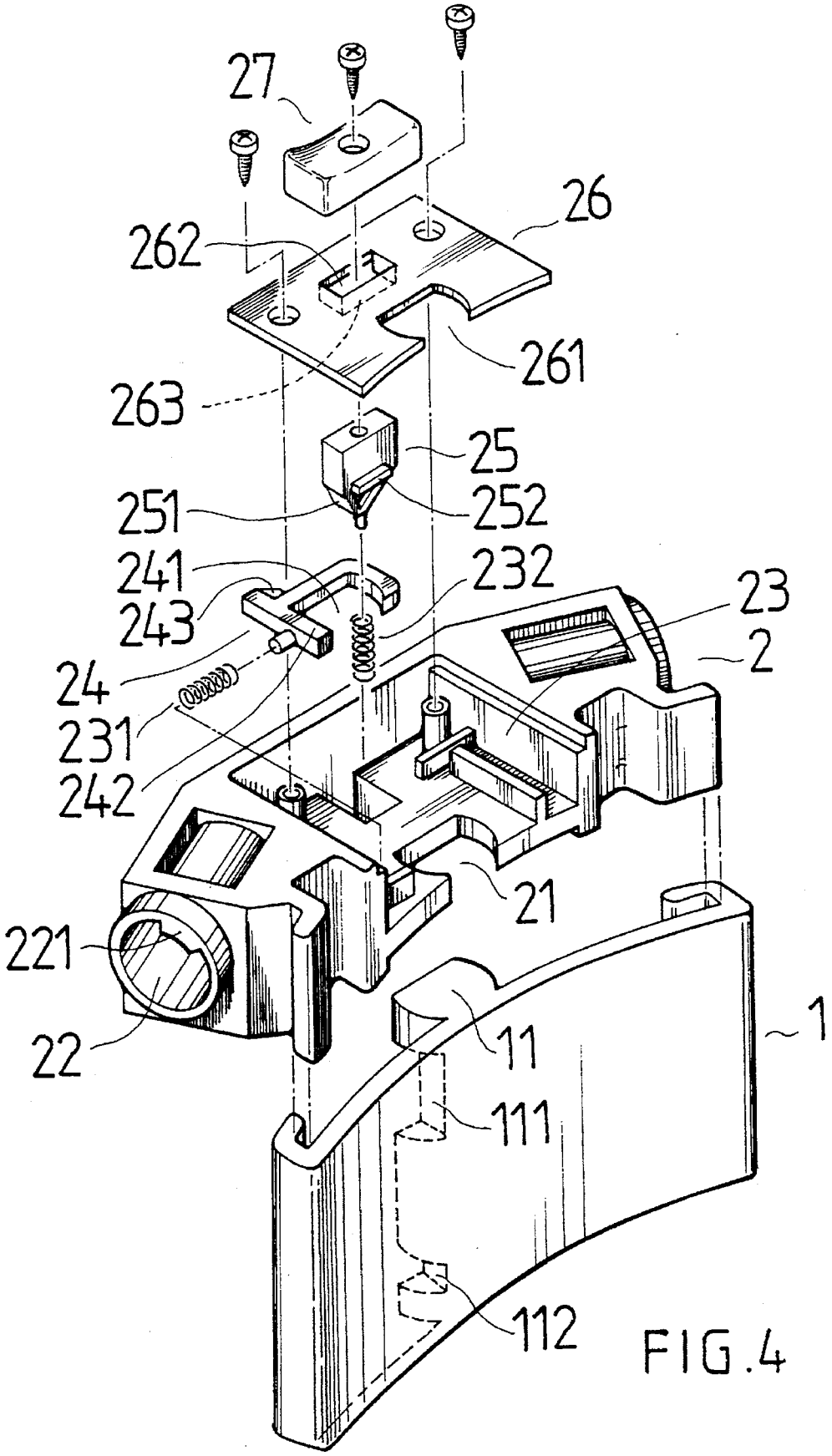
FIG. 4 is an exploded view of a fixed plate and a movable block of a controlling means of a golf bag stand of the present invention.
Figure 9:
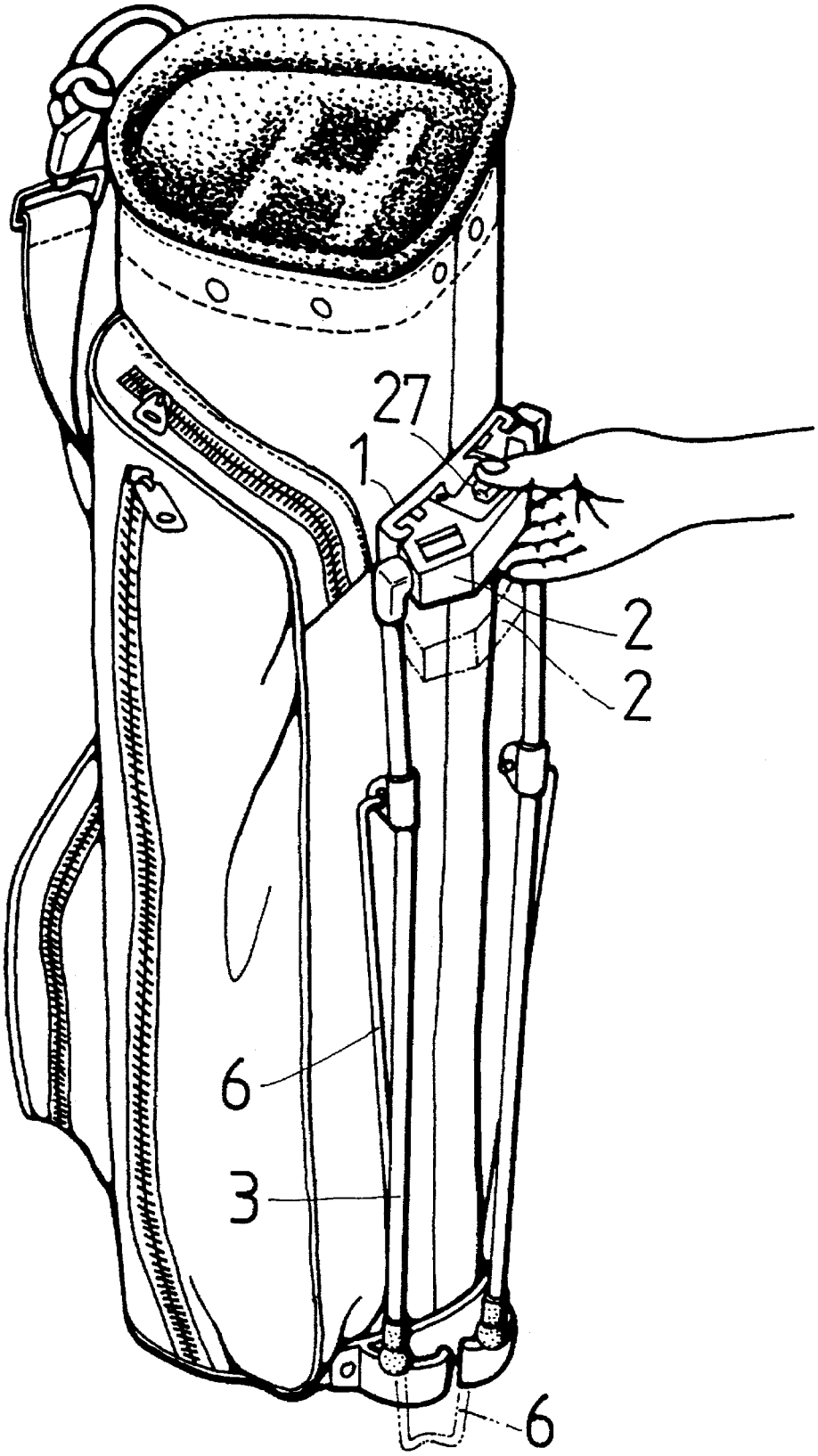
FIG. 9 is a perspective view showing a golf bag with a not-in-use stand provided with a controlling means of the present invention.
Figure 10:
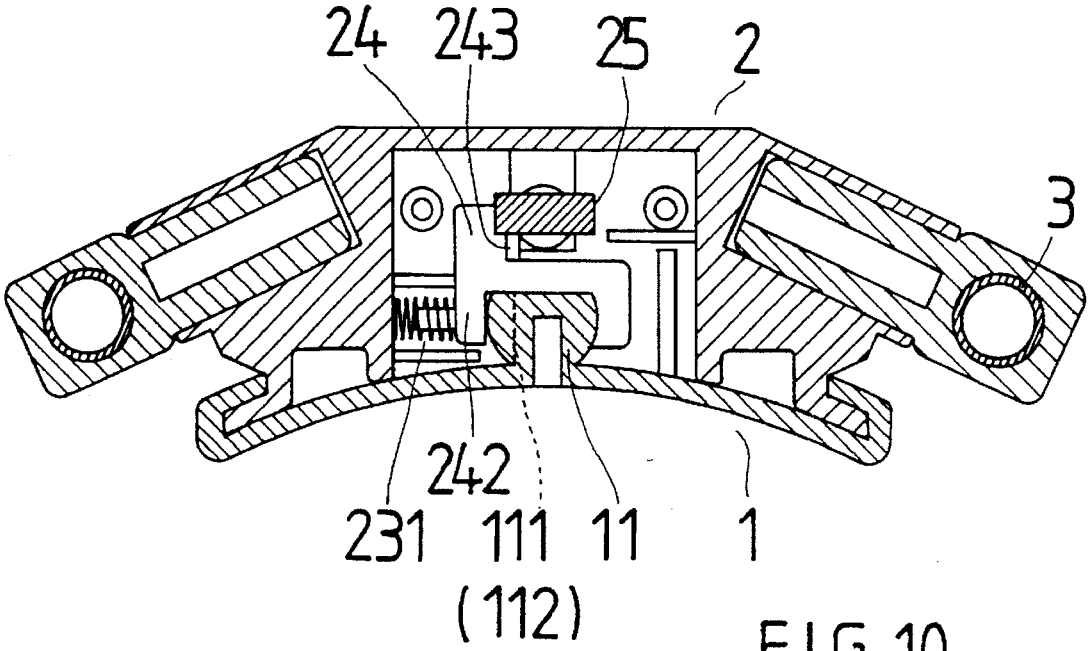
FIG. 10 is a horizontal sectional view of a movable block under movement of a controlling means of a golf bag stand of the present invention.
Figure 7:
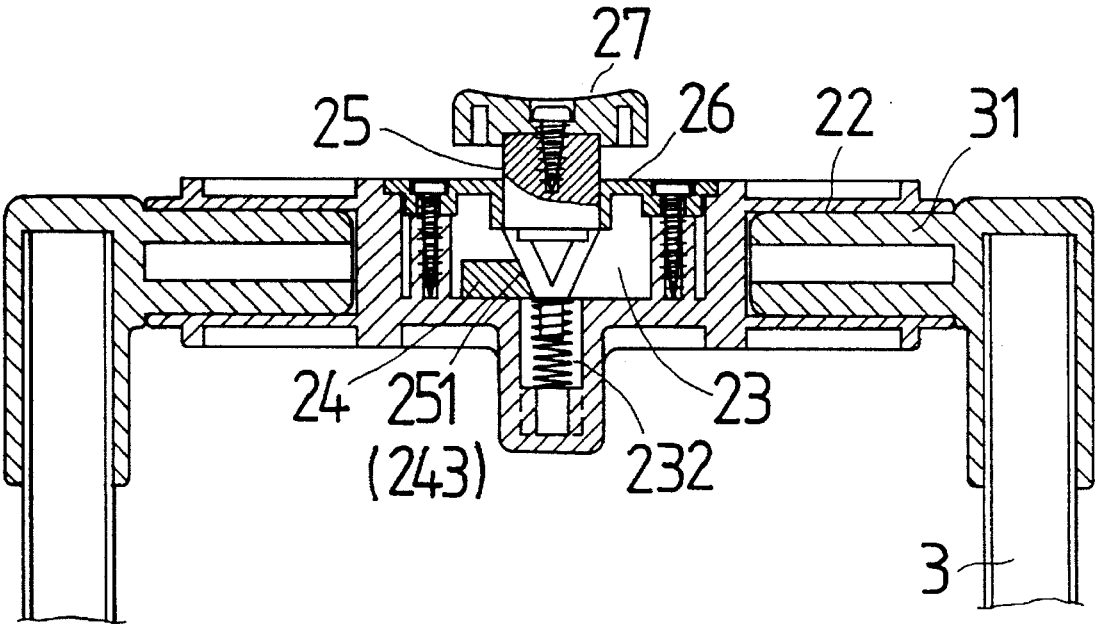
FIG. 7 is a horizontal-sectional view of a movable block combined with propping bars of a controlling means of a golf bag stand of the present invention.
Figure 11:
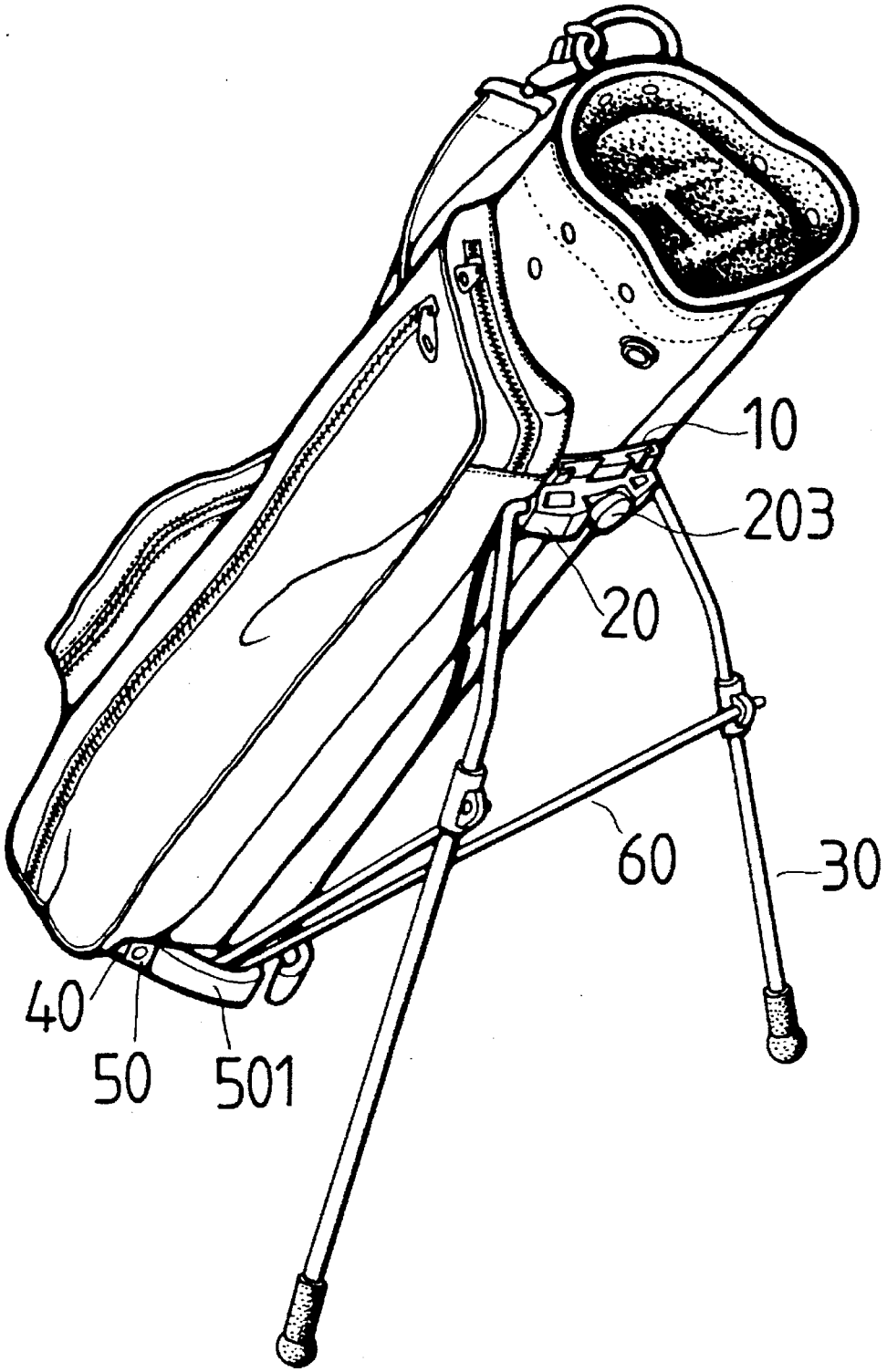
FIG.11 (PRIOR ART)
FIG. 11 is a view showing appearance of a golf bag and a golf bag stand provided with a heretofore known controlling means.
Figure 12:
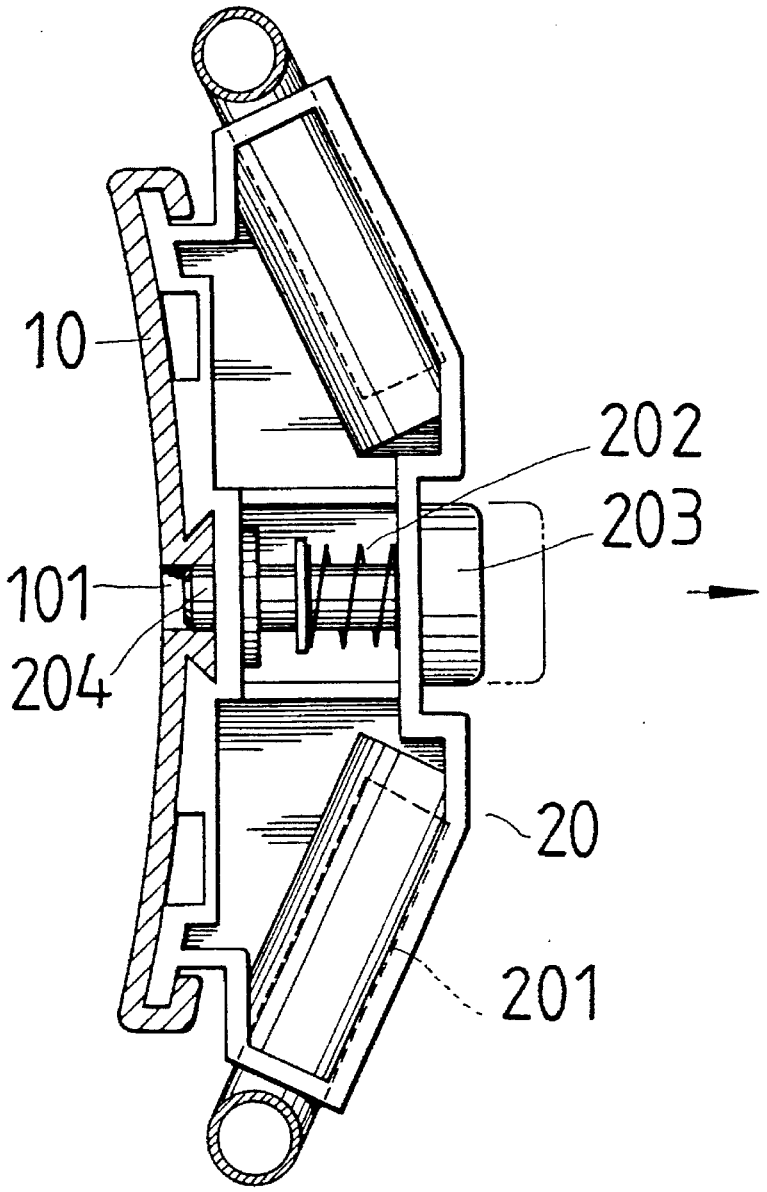
FIG. 12 (PRIOR ART)
FIG. 12 is a horizontal-sectional view of a fixed plate combined with a movable block of a heretofore known controlling means of a golf bag stand.
Figure 13:
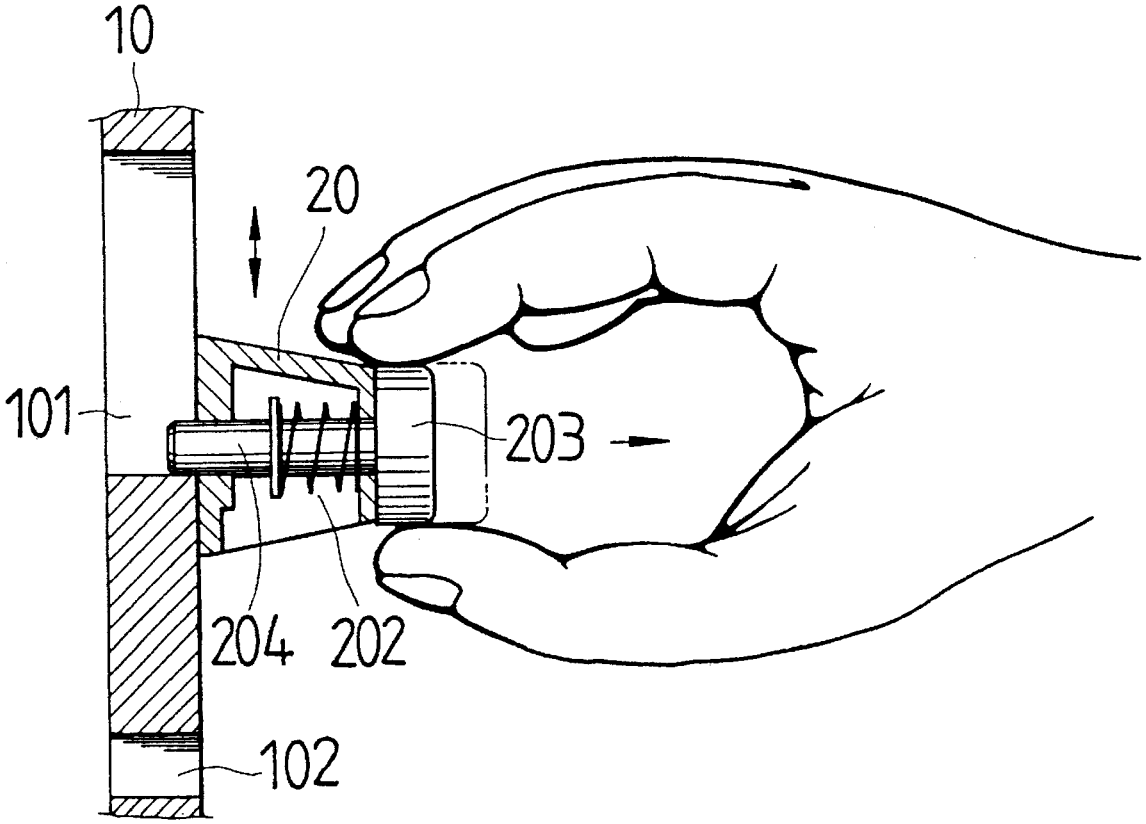
FIG.13 (PRIOR ART)
FIG. 13 is a side-sectional view of a fixed plate combined with a movable block of a heretofore known controlling means of a golf bag stand.
Figure 14:
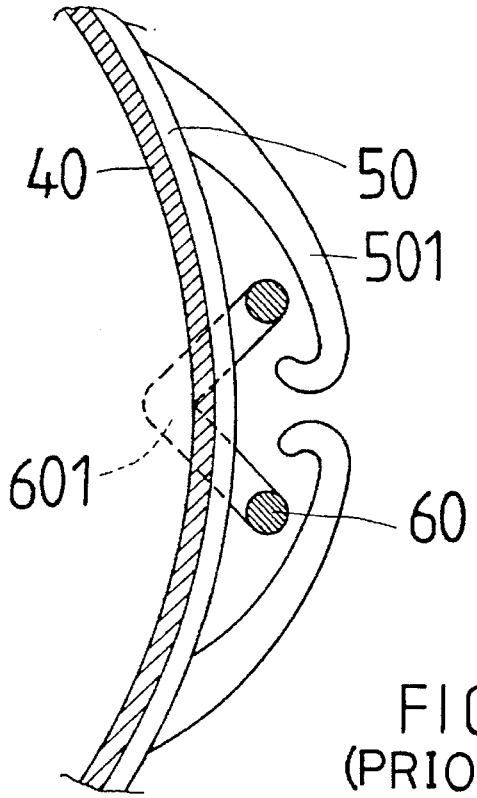
FIG. 14 (PRIOR ART)
FIG. 14 is a cross-sectional view of a bottom part, a blocking plate and a U-shaped bar combined together of a heretofore known controlling means of golf bag stand; and, FIG. 15 is a side-sectional view of a bottom part, a blocking plate and a U-shaped bar combined together of a heretofore known controlling means of a golf bag stand.
Figure 15:
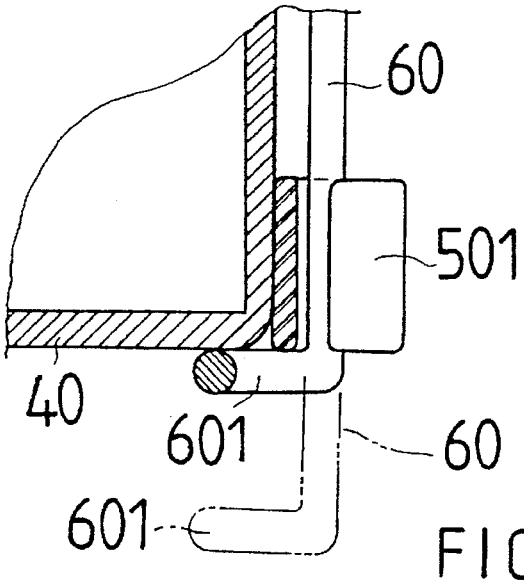
FIG. 15 (PRIOR ART)

A controlling means of a golf bag stand of the present invention, as shown in FIG. 1, comprises a fixed plate 1, a movable block 2, a U-shaped bar 6, a pair of propping bars 3, a blocking plate 5, curved bars 51 and a bottom part 4. The fixed plate 1 is coupled to an upper portion of a golf bag. The movable block 2 is operatively associated with the fixed plate I to move up and down thereon. The pair of propping bars 3 are provided to support the golf bag, and the bottom part 4 is coupled to a bottom portion of the golf bag, with the blocking plate 5 being coupled to the bottom part 4. The curved bars 51 are connected with the blocking plate 5 for securing a lower portion of the U-shaped bar 6. The U-shaped bar 6 is shaped as a "U", having a bottom end 61 bent at an angle and able to move relative to the propping bars 3 by means of two ends thereof movably associated with the propping bars 2.

The upper ends of the propping bars 3 are bent at an angle and each end has a recessed surface 32 formed in the upper end. The movable block 2 has two holes 22 formed in two sides thereof to respectively house the bent portions of the propping bars 3.

The fixed plate i includes a guide 11 on the intermediate portion thereof, an upper recess 111 and a lower recess 112 being provided on an upper portion and a lower portion of the guide 11, respectively.

The movable block 2 further includes a cavity 23 on an intermediate portion thereof, a guide holding opening 21, a retained element 24, springs 231, 232, a pushing block 25, an upper plate 26, a finger element 27 and curved protrusions 221. The curved protrusions 221 are adapted to block the recessed surfaces 32 of the propping bars 3, to allow the propping bars to only stretch outwardly through a limited distance. The retained element 24 includes an inclined surface 243, a retained end 242 and a recessed portion 241. The pushing block 25 has an inclined surface 251 and a protrusion 252. The upper plate 26 has a guide holding opening 261 and a through hole 262. The finger element 27 and the pushing block 25 are coupled together with the upper plate 26 positioned in between. The retained element 24 is housed inside the cavity 23. The recessed portion 241 and the guide holding openings 21, 261 are operationally associated with, and able to move relatively to, the guide 11 of the fixed plate 1. The upper plate 26 is connected to the movable block 2, over the cavity 23, by screws (not numbered). The pushing block 25 is positioned above the retained element 24 with the inclined surface 251 thereof positioned above the inclined surface 243 of the retained element 24, the springs 231, 232 being operationally associated with the retained element 24 and the pushing block 25, respectively.

The movable block 2 is able to be moved between a first position for the golf bag stand to be in an in-use position and a second position for the golf bag stand to be in a not-in-use position. The retained end 242 of the retained element 24 is retained inside the upper recess 111 of the fixed plate 1 when the movable block 2 is in the first position. The retained end 242 is retained inside the lower recess 112 when the movable block 2 is in the second position. When the finger element 27 is pushed downward, the movable block 2 is moved between said first and said second positions so that the golf bag stand is shifted between the in-use and not-in-use positions. The pushing block 25 is simultaneously moved downwardly together with the finger element 27, the inclined surface 251 of the pushing block 25 thereby pushes against the inclined surface 243 for separating the retained end 242 from either the upper recess 111 or the lower recess 112. The spring 231 is provided for biasing the retained end 242 to snap back into either the upper recess 111 or the lower recess 112 by the spring force thereof. The spring 232 is provided for biasing the pushing block 25 away from the retained element 24 when the finger element 27 is released by a user.

Furthermore, a plate 263 is provided under the upper plate 26 which blocks the protrusion 252 of the pushing block 25 and thereby prevents the pushing block 25 from falling out of the through hole 262 of the upper plate 26.

When the movable block 2 is retained in the first position, the golf bag stand is positioned relatively close to the golf bag. When the movable block 2 is moved to and retained in the second position, the golf bag will get supported by the propping bars to stand at an angle. The propping bars 3 of the golf bag stand are simultaneously stretched outwardly, the bent portions of the propping bars 3 being able to be revolved inside the holes 22 of the movable block 2. The weight of the golf bag and golf clubs inside the golf bag is applied to the U-shaped bar 6 standing on the ground. The U-shaped bar 6 is stretched outwardly by the weight and causes the propping bars 3 to be further stretched outwardly. Eventually, the bent bottom end 61 moves up to touch the blocking plate 5 and stops there.

To move the movable block 2 upward from the second position to the first position, a user can hold a bottom portion of the movable block 2 with four fingers and push the finger element 27 downward with the thumb to make it movable, and then move it upward with the four fingers.

From the above described controlling means of a golf bag stand, it can be understood that it has advantages as follows;

1. using the user's thumb to push the finger element 27 to make the movable block 2 movable, operation of the controlling means of a golf bag stand is relatively convenient in terms of biomechanics;

2. the exertion of force by a user's thumb to make the movable block 2 both able to move downward and to physically move downward, is the same, and the user will not feel pain on the thumb nor have to exert too much effort; and, 3. using the curved protrusions 221 to engage with the recessed surfaces 32 of the propping bars 3, outward stretching of the propping bars 3 can be defined properly and the golf bag stand can support the golf bag relatively stably.

While the preferred embodiments of the invention have been described above, it will be recognized and understood that various modifications may be made therein and the appended claims are intended to cover all such modifications which may fall within the spirit and scope of the invention.

What is claimed is:

1. A controlling device of a golf bag stand coupled to a golf bag, comprising:

a blocking plate coupled to a bottom portion of the golf bag, said blocking plate having a pair of curved bars coupled thereto;

a fixed plate secured to an upper end of the golf bag, said fixed plate having a guide formed in an intermediate portion thereof, said guide having an upper recess formed in an upper portion thereof and a lower recess formed in a lower portion thereof;

a movable block having a guide holding opening formed therethrough for slidable coupling to said guide of said fixed block, said movable block having a cavity formed therein and a pair of apertures formed respectively in opposing sides of said movable block;

an upper plate coupled to said movable block and covering said cavity, said upper plate having an opening formed therethrough;

a pushing block slidably disposed within said opening in said upper plate and having a lower end extending into said cavity, said pushing block having a protrusion and a first inclined surface formed on said lower end thereof;

a retained element disposed in said cavity and having an end portion thereof engageable with a selected one of said upper recess and said lower recess, said retained element having a second inclined surface adapted to interface with said first inclined surface for disengagement of said end portion of said retained element from said selected one of said upper recess and said lower recess responsive to a downward displacement of said pushing block relative to said upper plate, said movable block being slidably displaceable on said fixed plate responsive to said disengagement of said end portion of said retained element;

a first spring operatively coupled to said lower end of said pushing block for biasing said pushing block away from said retained element;

a second spring operatively coupled to said retained element for biasing said end portion thereof into said engagement with said selected one of said upper recess and said lower recess;

a pair of propping bars pivotally coupled to said movable block, each of said pair of propping bars having an end portion pivotally disposed in a respective one of said pair of apertures of said movable block; and, a U-shaped bar having opposing ends thereof pivotally coupled respectively to said pair of propping bars and an intermediate portion captured between said blocking plate and said pair of curved bars for rotatively displacing said pair of propping bars responsive to said slidable displacement of said movable block.

2. The controlling device as recited in claim 1 further comprising a plate coupled to a lower side of said upper plate and positioned for contact with said protrusion of said pushing block to limit displacement thereof through said opening in said upper plate.

3. The controlling device as recited in claim 1 where said movable block has a pair of protrusions disposed respectively in said pair of apertures and said end portion of each of said pair of propping bars has a recess formed therein for receiving a respective one of said pair of protrusions of said movable block therein for limiting said rotative displacement of said pair of propping bars.

4. The controlling device as recited in claim 3 further comprising a plate coupled to a lower side of said upper plate and positioned for contact with said protrusion of said pushing block to limit displacement thereof through said opening in said upper plate.

* * * * *